US005881725A

United States Patent [19]

Hoffman et al.

[11] Patent Number: 5,881,725

[45] Date of Patent: Mar. 16, 1999

[54] PNEUMATIC OXYGEN CONSERVER

[75] Inventors: Richard E. Hoffman, Overland Park; Thomas W. Nelson, Lenexa, both of Kans.; Richard W. Miller, Denton; Michael V. Ostrom, Decatur, both of Tex.

[73] Assignee: Victor Equipment Company, Denton, Tex.

[21] Appl. No.: 917,436

[22] Filed: Aug. 19, 1997

[51] Int. Cl.[6] ..... A62B 9/02

[52] U.S. Cl. ..... 128/204.26; 128/204.29; 128/205.24

[58] Field of Search ..... 128/204.26, 202.22, 128/204.24, 204.23, 204.21, 204.18, 205.24, 204.29; 600/534

[56] References Cited

U.S. PATENT DOCUMENTS

| | | |
|---|---|---|
| 2,318,827 | 5/1943 | Yant . |
| 2,552,595 | 5/1951 | Seeler . |
| 3,285,261 | 11/1966 | Chaney . |
| 3,400,713 | 9/1968 | Finan . |
| 3,434,471 | 3/1969 | Liston . |
| 3,524,464 | 8/1970 | Glidden . |
| 3,776,422 | 12/1973 | Wise . |
| 3,783,891 | 1/1974 | Christianson . |
| 3,815,593 | 6/1974 | Baumont . |

(List continued on next page.)

FOREIGN PATENT DOCUMENTS

WO 87/02590 5/1987 WIPO .

OTHER PUBLICATIONS

Ohmeda advertisement entitled, "Ohmeda/Pulse Oximeter", published prior to Aug. 19, 1997.

DeVILBISS advertisement entitled, "Pulse/Dose", copyrighted 1994.

Pulsair, Inc. advertisement entitled, "Pulsair Walkabout", copyrighted 1991.

Perry Oxygen Systems Inc. advertisement entitled, "Pulsed Oxygen On Demand", published prior to Aug. 19, 1997.

Pulsair technical memorandum entitled, "Pulsair ® Oxygen Delivery System", copyrighted 1990.

Puritan Bennett advertisement entitled, "It All Adds Up . . .", published prior to Aug. 19, 1997.

CHAD Therapeutics advertisement entitled, "Not all home oxygen patients should be homebodies . . . ", published prior to Aug. 19, 1997.

*Primary Examiner*—John G. Weiss
*Assistant Examiner*—Charles W. Anderson
*Attorney, Agent, or Firm*—Senniger, Powers, Leavitt & Roedel

[57] ABSTRACT

A pneumatic oxygen conserver used with a single-tube cannula. The conserver includes a body having first and second cavities. A main diaphragm divides the first cavity into first and second chambers. An inlet passage delivers oxygen from a supply to the first chamber, and an outlet passage delivers oxygen from the first chamber to the cannula. The main diaphragm is movable between a closed position preventing oxygen flow through the outlet passage and an open position permitting flow. A first flow control passage connects the inlet passage and the second chamber, and a first flow control orifice in the passage restricts flow. A sensing diaphragm divides the second cavity into third and fourth chambers. A second flow control passage connects the second and third chambers, and a second flow control orifice in the passage restricts flow. The sensing diaphragm is movable between a closed position preventing flow through the second passage and an open position permitting such flow. A vent passage vents the third chamber. A sensing passage connects the outlet passage and the fourth chamber. Inhalation into the cannula moves the sensing diaphragm to its open position to vent the second and third chambers causing the main diaphragm to move to its open position for delivering oxygen to the cannula.

22 Claims, 6 Drawing Sheets

U.S. PATENT DOCUMENTS 4,054,133 10/1977 Myers .
4,060,078 11/1977 Bird .
4,076,041 2/1978 Christianson .
4,127,123 11/1978 Bird .
4,253,455 3/1981 Netteland .
4,269,216 5/1981 Sullivan et al. .
4,278,110 7/1981 Price et al. .
4,340,045 7/1982 Manley .
4,374,521 2/1983 Nelson et al. .
4,381,002 4/1983 Mon .
4,461,293 7/1984 Chen .
4,462,398 7/1984 Durkan et al. .
4,567,888 2/1986 Robert et al. .
4,575,042 3/1986 Grimland et al. .
4,612,928 9/1986 Tiep et al. .
4,651,731 3/1987 Vicenzi et al. .
4,665,911 5/1987 Williams et al. .
4,667,670 5/1987 Feathers .
4,681,099 7/1987 Sato et al. .
4,705,034 11/1987 Perkins .
4,706,664 11/1987 Snook et al. .
4,744,356 5/1988 Greenwood .
4,784,130 11/1988 Kenyon et al. .
4,823,788 4/1989 Smith et al. .
4,848,332 7/1989 Champain .
4,856,507 8/1989 Quillon et al. .
4,858,606 8/1989 Hamlin .
4,873,971 10/1989 Perkins .
4,898,174 2/1990 Fangrow, Jr. .
4,928,684 5/1990 Breitenfelder et al. .
4,932,401 6/1990 Perkins .
4,932,402 6/1990 Snook et al. .
4,971,049 11/1990 Rotariu et al. .
4,986,269 1/1991 Hakkinen .
5,005,570 4/1991 Perkins .
5,016,626 5/1991 Jones .
5,024,219 6/1991 Dietz .
5,038,770 8/1991 Perkins .
5,038,771 8/1991 Dietz .
5,048,515 9/1991 Sanso .
5,074,299 12/1991 Dietz .
5,165,397 11/1992 Arp .
5,247,926 9/1993 Harral .
5,348,001 9/1994 Danon .
5,360,000 11/1994 Carter .
5,370,112 12/1994 Perkins .
5,386,824 2/1995 Nelepka ..... 128/204.18
5,390,666 2/1995 Kimm et al. .
5,464,009 11/1995 Tatarek-Gintocut ..... 128/205.24
5,603,315 2/1997 Sasso, Jr. .
5,685,297 11/1997 Schuler ..... 128/205.24
5,701,889 12/1997 Danon ..... 128/204.29

PNEUMATIC OXYGEN CONSERVER

BACKGROUND OF THE INVENTION

This invention relates generally to oxygen delivery systems, and more particularly to a system which includes an oxygen conserver which operates pneumatically to provide oxygen on demand (i.e., upon inhalation).

Oxygen delivery systems of the type used by ambulatory persons, for example, typically include a source of oxygen (e.g., an oxygen bottle) for holding a supply of oxygen at pressures of up to about 3000 psi, a regulator system for reducing the pressure of the oxygen to a pressure suitable for breathing, and a cannula for delivering oxygen to the person. To increase the life of the oxygen supply, oxygen conservers are frequently used. These devices interrupt the flow of oxygen to the person using the system, either in response to exhalation, or at timed intervals, thereby reducing the rate of oxygen consumption.

Conservers are generally of two types, those which operate electrically and those which operate pneumatically. Electronic conservers require a power source (e.g., batteries) for operation, thus necessitating periodic replacement or recharging of the power source. The remaining life of the power source, which users of the system must take into consideration, can be uncertain. Pneumatic conservers, on the other hand, are operated by the inhalation and exhalation of the person using the system. They require no power source and thus have a significant advantage over electrical conservers. However, unlike electronic conservers which typically use a standard single-tube cannula, conventional pneumatic conservers generally require a double-tube cannula, one tube for supplying oxygen to the person wearing the cannula, and the other for connection to a sensing port on the conserver. The pneumatic conserver responds to changes in pressure in the sensing tube to provide oxygen to the person during inhalation, and to interrupt the flow of oxygen to the person during exhalation (when oxygen is not needed). Due to their lesser availability, expense, weight and bulk, double-tube cannulas are not popular. As a result, the use of pneumatic conservers is not widespread, despite their inherent advantages over electrical conservers. Moreover, conventional pneumatic conservers are relatively complex in design, requiring a series of spring-activated diaphragms and the like.

Some prior oxygen conservers are selectively operable in two modes. In the first (oxygen conserving) mode, oxygen is supplied to the user of the system on an interrupted basis, as described above. In the second (continuous flow) mode, a continuous stream of oxygen is provided to the user during both inhalation and exhalation. (Continuous delivery during the entire breathing cycle is not necessary for health reasons, but some persons prefer this.) These conservers are sometimes equipped with a flow control mechanism which can be adjusted to vary the rate at which oxygen is delivered. However, in prior systems, this mechanism has been operable only in the oxygen conserving mode, not in the continuous mode. Another disadvantage of certain prior oxygen delivery systems is that they are rather bulky, which makes such systems more obtrusive and reduces mobility.

There is a need, therefore, for a pneumatic oxygen conserver which can be used as part of a delivery system which overcomes the disadvantages of prior systems.

SUMMARY OF THE INVENTION

Among the several objects of this invention may be noted the provision of a pneumatic oxygen conserver which is designed for use with a single-tube cannula; the provision of such a conserver which does not include springs, thereby reducing the complexity of the device; the provision of such a conserver which is selectively operable in either an oxygen conserving mode or in a continuous flow mode, and which is equipped for adjustment of the oxygen flow rate in both modes; the provision of such a conserver which is durable and reliable in operation; the provision of a conserver/regulator unit which is compact and easily serviceable by technicians; and the provision of such a unit which is attractive in appearance.

Briefly, apparatus of this invention is a pneumatic oxygen conserver used with a single-tube cannula. The conserver comprises a body having first and second cavities. A main diaphragm divides the first cavity into first and second chambers. An inlet passage delivers oxygen from a supply to the first chamber, and an outlet passage delivers oxygen from the first chamber to the cannula. The main diaphragm is movable between a closed position preventing oxygen flow through the outlet passage and an open position permitting flow. A first flow control passage connects the inlet passage and the second chamber, and a first flow control orifice in the passage restricts flow. A sensing diaphragm divides the second cavity into third and fourth chambers. A second flow control passage connects the second and third chambers, and a second flow control orifice in the passage restricts flow. The sensing diaphragm is movable between a closed position preventing flow through the second passage and an open position permitting such flow. A vent passage vents the third chamber. A sensing passage connects the outlet passage and the fourth chamber. Inhalation into the cannula moves the sensing diaphragm to its open position to vent the second and third chambers causing the main diaphragm to move to its open position for delivering oxygen to the cannula. Exhalation into the cannula moves the sensing diaphragm to its closed position allowing the second chamber to pressurize causing the main diaphragm to move to its closed position to interrupt the oxygen flow to the cannula.

In another aspect of the invention, the conserver comprises a body having an inlet passage for receiving oxygen from an oxygen source and an outlet passage adapted for connection to a cannula for delivering oxygen to a person. The conserver also comprises an oxygen conserving mechanism in the body which is operable in an oxygen conserving mode to permit oxygen to flow from the inlet passage to the outlet passage of the body during inhalation by the person and to block the flow of oxygen to the outlet passage during exhalation by the person. The mechanism is also operable in a continuous flow mode to permit the continuous oxygen flow to the person during both inhalation and exhalation. Further, the conserver comprises a flow control mechanism on the conserver body which is operable when the conserving mechanism is in either mode to vary the rate of oxygen flow through the outlet passage.

In yet another aspect of the present invention, the conserver is a springless pneumatic oxygen conserver wherein the main and sensing diaphragms are movable between their open and closed positions without the use of springs.

In still another aspect, apparatus of the present invention is an oxygen conserver/regulator unit comprising a housing, a regulator in the housing, and a pneumatic oxygen conserver in the housing immediately adjacent the regulator. The unit also includes an opening in the housing for connecting an inlet of the regulator to a source of oxygen, and an opening in the housing for connecting the conserver outlet passage to the cannula.

Other objects and features will be in part apparent and in part pointed out hereinafter.

BRIEF DESCRIPTION OF THE DRAWINGS

Corresponding parts are designated by corresponding reference characters throughout the several views of the drawings.

DETAILED DESCRIPTION OF THE PREFERRED EMBODIMENT

Figure 1:
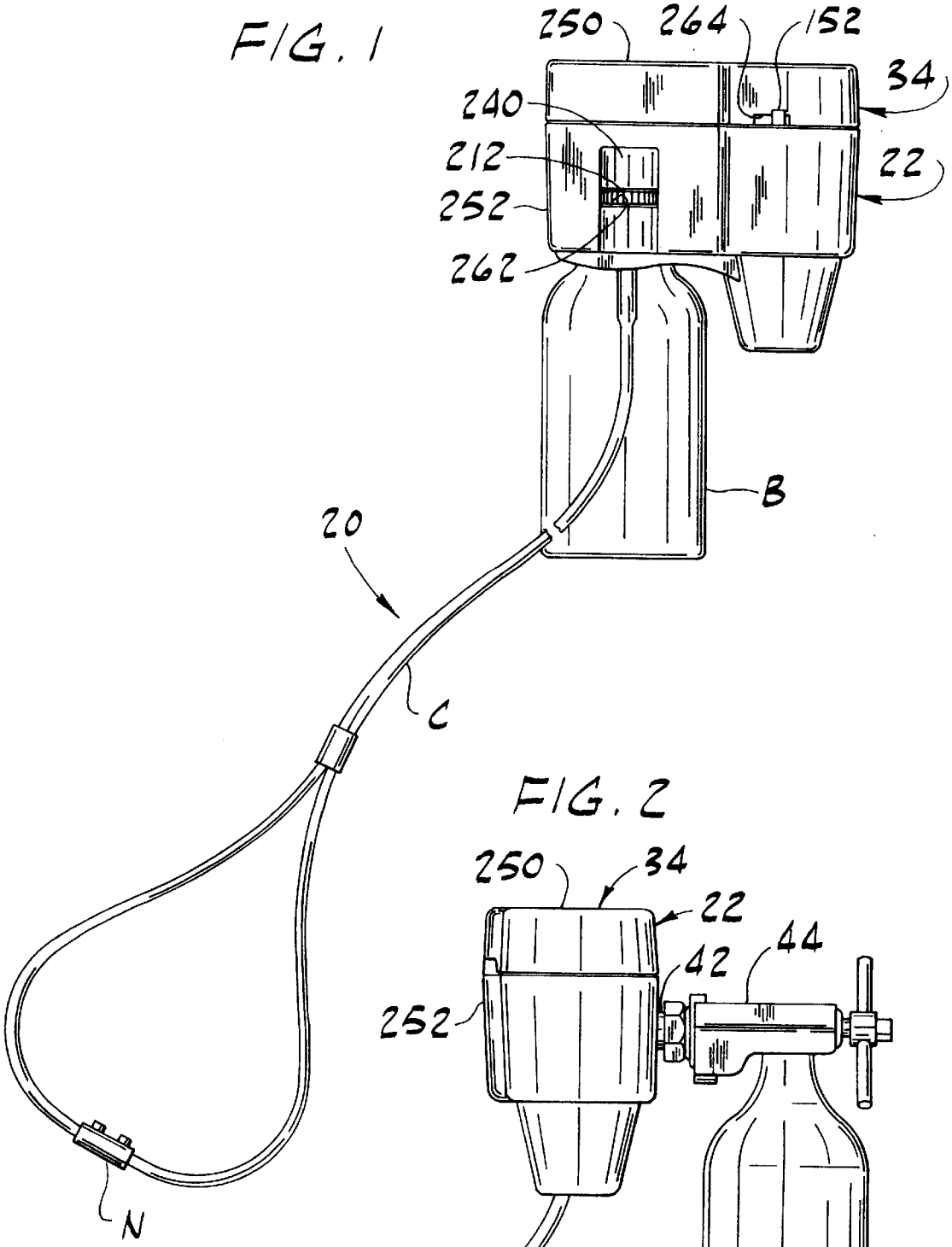
FIG. 1 is a front elevation of an oxygen delivery system incorporating an oxygen conserver/regulator unit of the present invention.

Referring now to the drawings, and first more particularly to FIG. 1, an oxygen delivery system is designated in its entirety by the reference numeral 20. The system comprises a cylinder or bottle B of oxygen containing oxygen under pressure (up to about 3000 psi), an oxygen conserver/regulator unit of the present invention, generally designated 22, and a standard single-tube cannula C comprising a length of plastic tubing formed into a loop having a nosepiece N for delivering oxygen to the nose of a person or patient wearing the cannula.

Figure 2:
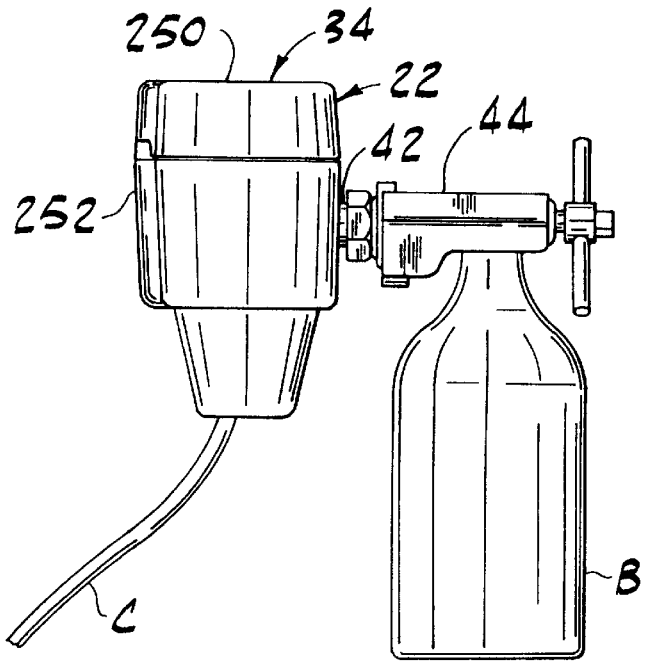
FIG. 2 is a partial side elevation of the system.
Figure 3:
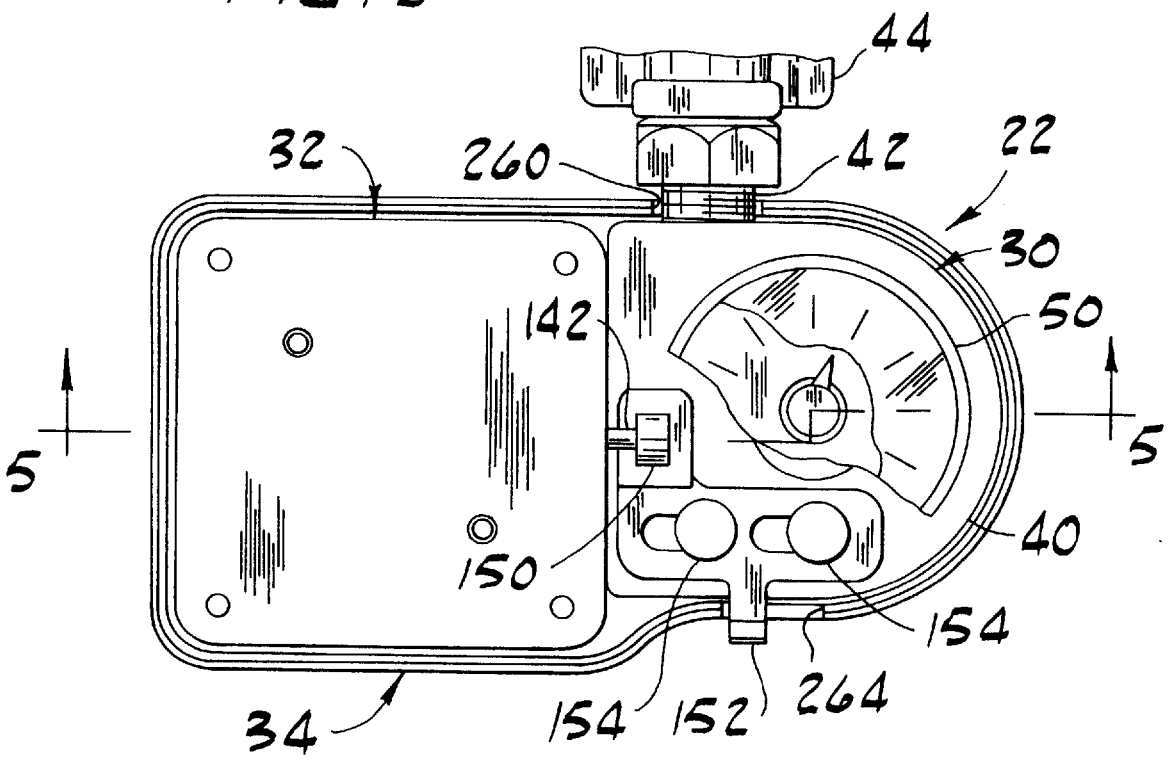
FIG. 3 is a top plan of the oxygen conserver/regulator unit of the present invention shown with an upper part of a housing removed and a switch positioned for operating the unit in a continuous mode.
Figure 4:
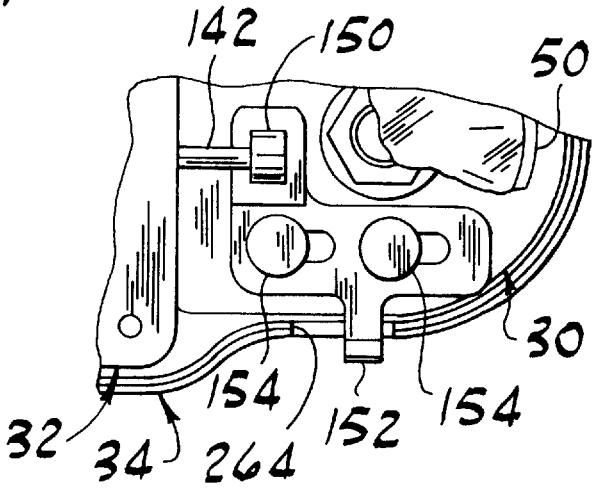
FIG. 4 is a partial top plan of the unit similar to FIG. 3 but shown with the switch positioned for operation in a conserve mode.

As illustrated in FIG. 3, the unit 22 includes three major components, namely, a regulator (generally designated 30), a pneumatic oxygen conserver (generally designated 32) and a housing (generally designated 34) for housing both the regulator and the conserver. As will be apparent from FIGS. 1 and 2, enclosing the regulator 30 (FIG. 3) and conserver 32 (FIG. 3) in a common housing provides for a compact design which enhances convenience of use and reduces the obtrusiveness of the overall system 20. In addition, enclosing the regulator 30 and conserver 32 in a common housing eliminates the need for user provided connectors between the regulator and conserver which can leak and come loose.

Figure 5:
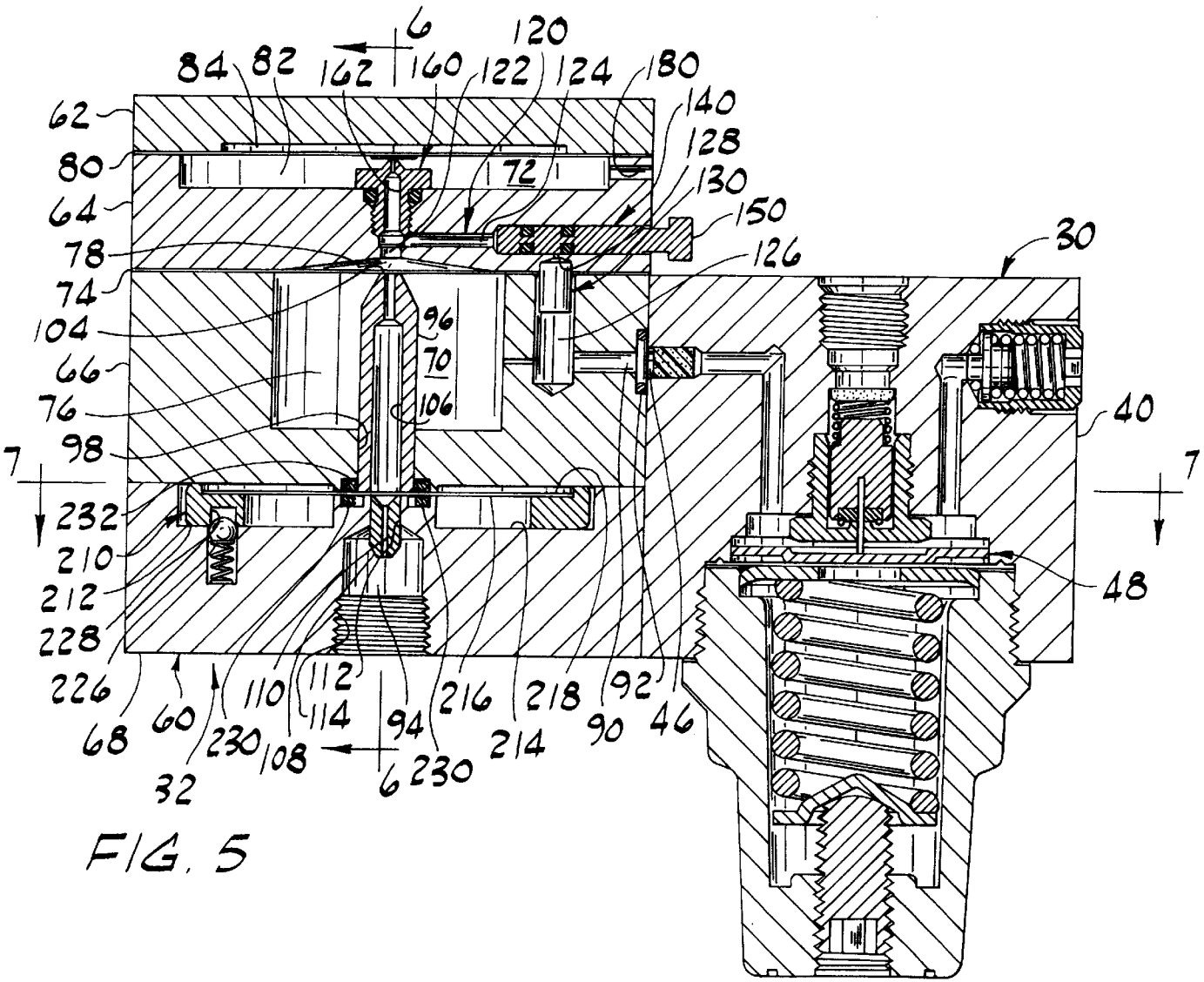
FIG. 5 is cross section of the oxygen conserver/regulator unit taken in the plane of line 5—5 of FIG. 3 and shown without the housing.

As illustrated in FIG. 3, the regulator 30 comprises a regulator body 40 having an inlet 42 adapted for connection to the bottle B (FIG. 2) by means of a yoke device, indicated at 44, the construction and operation of which is known in the art. One such yoke device 44 is described in allowed U.S. patent application Ser. No. 08/542,450, filed Oct. 2, 1995. As illustrated in FIG. 5, the regulator body 40 also has an outlet 46. A pressure regulating mechanism, generally designated 48, of conventional design is provided in the regulator body 40. This mechanism 48 is operable to receive oxygen from the inlet 42 at a first pressure (e.g., 2000 psi corresponding to the bottle pressure) and to reduce the pressure of the oxygen to a second lower pressure (e.g., 25 psi) for delivery of the lower-pressure oxygen to the outlet 46 of the regulator 30. A regulator 30 suitable for use may be obtained from Victor Equipment Company located in Denton, Tex. One such regulator 30 is described in U.S. Pat. No. 4,679,582, issued Jul. 14, 1987. As illustrated in FIG. 3, the regulator 30 includes a pressure gage 50 with a dial for monitoring the supply of oxygen in the bottle B.

Figure 6:
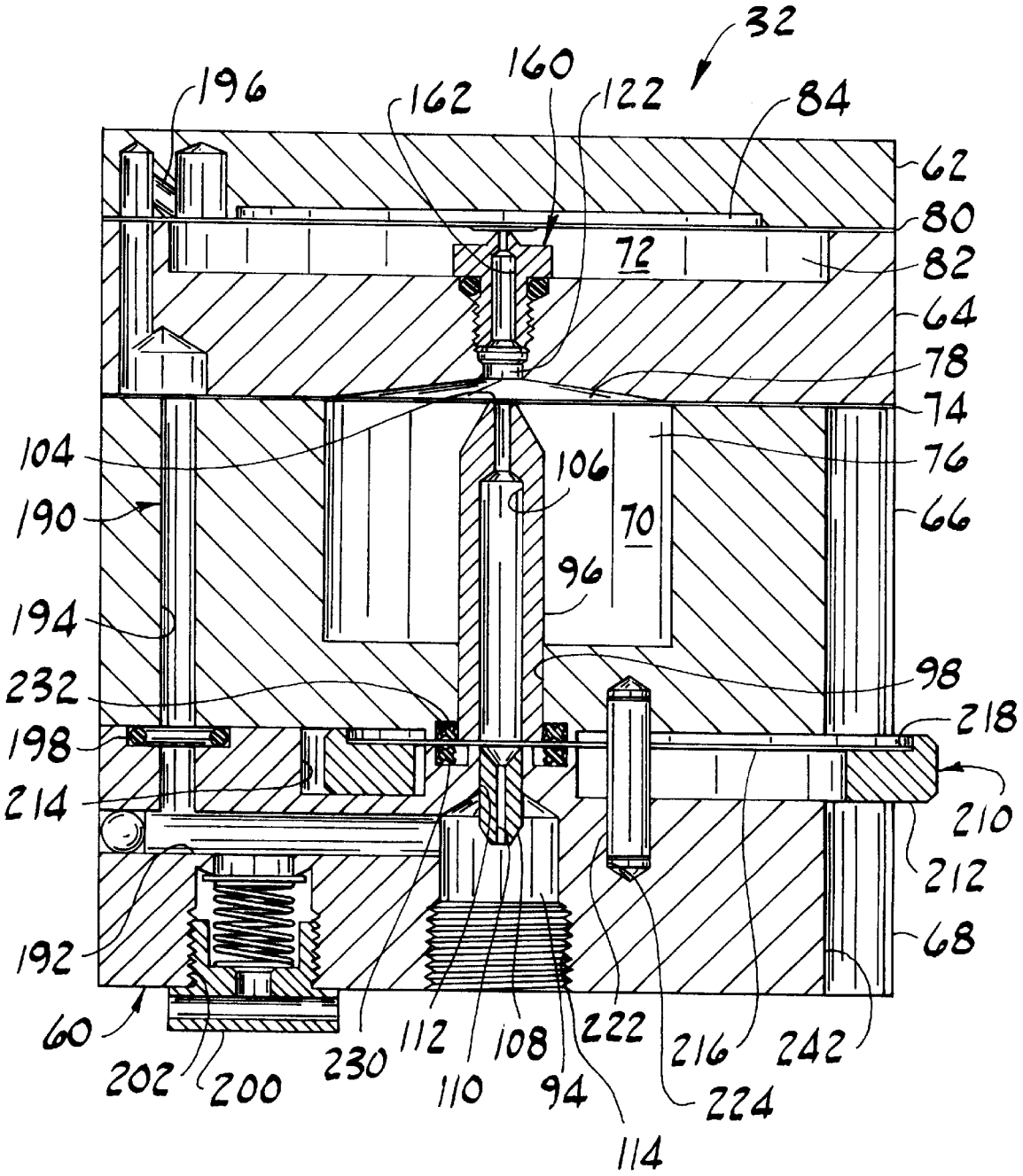
FIG. 6 is a cross section of the oxygen conserver/regulator unit taken in the plane of line 6—6 of FIG. 5.

The construction of the conserver 32 is shown in FIGS. 5 and 6. It comprises a generally cube-shaped body, generally designated 60, of suitable material (e.g., aluminum) fabricated from a plurality of separate parts secured together by fasteners to form a unitary assembly. In the particular embodiment shown in the drawings, the body 60 includes four blocks, identified for convenience as a top block 62, a sensor block 64 below the top block, an inlet block 66 below the sensor block, and an outlet block 68. The conserver body 60 is positioned immediately adjacent the regulator body 40 within the housing 34, the two bodies being in immediate face-to-face relation and preferably in contact with one another for maximum compactness. The bodies 40, 60 are releasably fastened together with screw fasteners (not shown).

The conserver body 60 is formed with a first cavity 70 defined by recesses in the sensor and inlet blocks 64, 66, respectively, and a second cavity 72 defined by recesses in the top and sensor blocks 62, 64, respectively. A main diaphragm 74 extends across the first (lower) cavity 70 and divides it into first and second chambers 76, 78, respectively, on opposite sides of the diaphragm, the first chamber being below the diaphragm and the second above it. A sensing or pilot diaphragm 80 extends across the second (upper) cavity 72 and divides it into third and fourth chambers 82, 84, respectively, on opposite sides of the diaphragm, the third chamber being below the diaphragm and the fourth above the diaphragm.

An inlet passage 90 in the conserver body 60 extends from the outlet 46 of the regulator 30 to the first chamber 76 below the main diaphragm 74. The passage 90 has a relatively large diameter section adjacent the regulator for holding an O-ring 92 to prevent leakage, and a smaller diameter section adjacent the chamber. Oxygen is delivered from the regulator 30 through this passage 90. An outlet passage 94 is also provided for delivering oxygen from the first chamber 76 to the aforementioned cannula C (FIG. 1). This passage 94 is defined in part by an outlet nozzle 96 press fit in a hole 98 extending up from the lower surface of the inlet block 66. The nozzle 96 extends up through the hole 98 into the first chamber 76 and has an upper end which tapers to a generally flat horizontal surface 104. The upper portion of the outlet passage 94 is defined by a vertical bore 106 which extends axially through the nozzle 96, the upper reach of this bore being of smaller diameter than the remainder of the bore. The lower portion of the outlet passage 94 is formed by a nozzle 108 having a vertical bore 110 press fit in a hole 112 through the outlet block 68. The bore 110 communicates with the lower end of the nozzle bore 106 and a larger hole 114 which is internally threaded at its lower end for receiving a fitting (not shown) for attachment of the cannula C to the conserver 32.

The main diaphragm 74 comprises a sheet of flexibly resilient material (e.g., silicone compound no. SF1311 provided by Burke Industries of Norwalk, Calif.) sandwiched between the sensing and inlet blocks 64, 66 of the conserver 32. As will be explained later in this description, the diaphragm 74 is movable between a closed position (FIG. 5) in which it engages the top surface 104 of the outlet nozzle 96 to prevent the flow of oxygen into the outlet passage 94, and an open position (not shown) in which the diaphragm is spaced above the top surface of the nozzle to permit flow through the outlet passage. When in a relaxed condition, the diaphragm 74 is slightly biased toward its closed position.

As best shown in FIG. 5, a first flow control passage, generally designated 120, connects the inlet passage 90 to the second chamber 78 above the main diaphragm 74. The flow control passage 120 comprises a lower section of a vertical passage 122 connecting the second and third chambers 78, 82 above and below the main diaphragm 74 and sensing diaphragm 80, respectively, a horizontal bore 124 in the sensing block 64 extending from the vertical passage to one side of the block, and a vertical bore 126 connecting the horizontal bore and the inlet passage 90. The upper end of the vertical bore 126 is formed by a recess 128 extending up from the lower surface of the sensing block 64.

Figure 9:
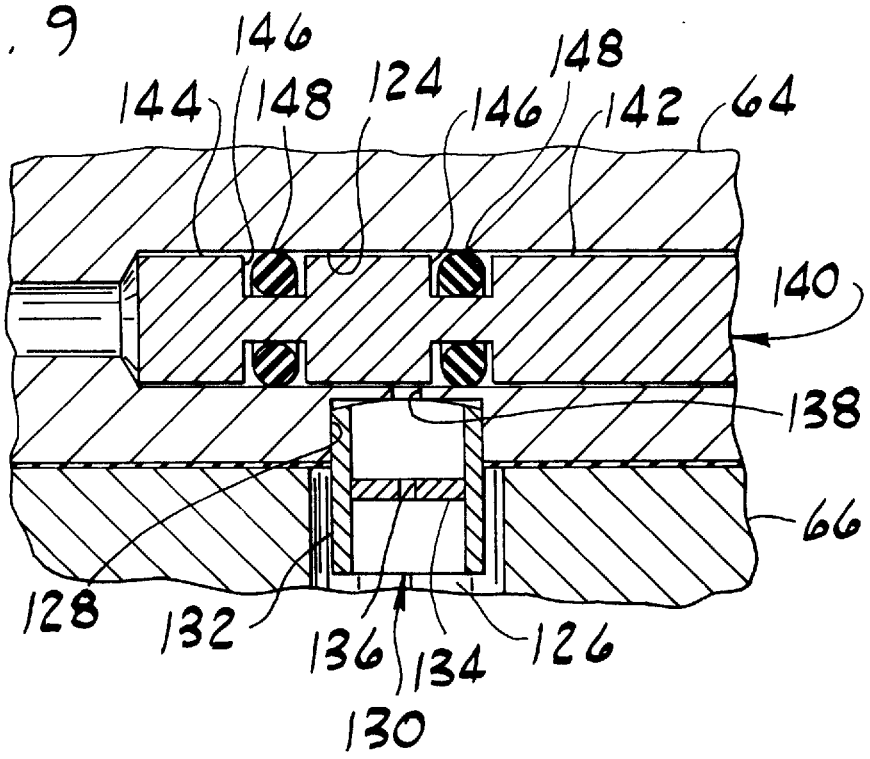
FIG. 9 is a detail of a flow control valve of the oxygen conserver/regulator unit shown positioned for operating the unit in a continuous mode.

A flow control orifice device, generally designated 130, is mounted in this recess 128. As best shown in FIG. 9, the device 130 comprises a tubular housing 132 having an orifice plate 134 therein formed with a flow control orifice 136 of precise dimension (e.g., a 0.0048–0.0054 in. orifice) for closely controlling the flow of oxygen through the first flow control passage 120. The orifice plate 134 may be a sapphire wafer, for example, having an orifice 136 of the required size and tolerance. A suitable flow control orifice device 130 is commercially available from O'Keefe Controls Company of Trumbull, Conn. The orifice device 130 functions to time the opening and closing of the main diaphragm 74, as will be discussed in more detail below. The vertical bore 126 includes a small-diameter flow hole 138 connecting the recess 128 and the horizontal bore 124. This hole 138 is larger in diameter than the first flow control orifice 136.

Figure 10:
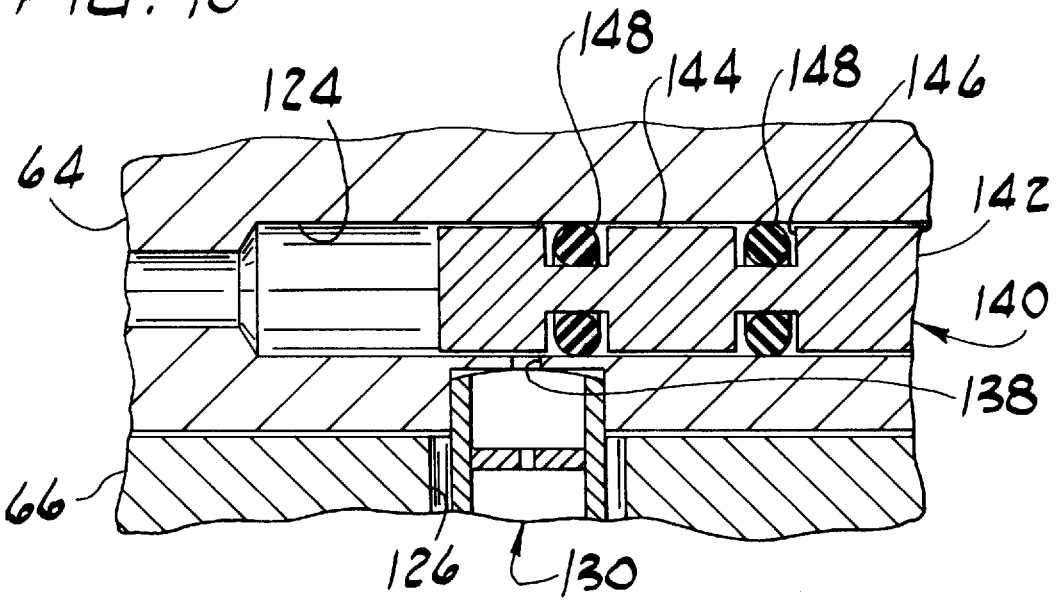
FIG. 10 is a detail of the flow control valve of the oxygen conserver/regulator unit shown positioned for operation in a conserve mode.

A valve, generally designated 140, is slidable in an enlarged portion of the horizontal bore 124 of the first control passage 120. As shown in FIG. 9, the valve 140 comprises a stem 142 having a diameter less than the diameter of the horizontal bore 124 to provide an annular gap 144 around the stem to allow for flow through the bore. The stem 142 has two spaced-apart annular grooves 146 which hold seals 148 (e.g., O-rings) for sealingly engaging the walls of the bore 124. As illustrated in FIG. 3, the stem 142 projects outward from the passage 120 at one side of the conserver body 60 and terminates in a valve head 150 which is connected to an actuator 152 mounted on the top surface of the regulator body 40. (The top surface of the regulator body is generally aligned with the top of the inlet block 66 of the conserver 32, and the pressure gage 50 extending up from the top of the regulator 30 is generally flush with the top of the conserver.) The actuator 152 has pin-and-slot connections 154 with the regulator body 40 and is manually movable back and forth for sliding the valve 140 between an open position (FIG. 10) in which both seals 148 on the valve stem 142 are to the right of the flow hole 138 to permit flow through the first control passage 120, and a closed position (FIG. 9) in which the flow hole is between the two seals to prevent flow through the passage. For reasons which will become apparent, the valve open position (FIG. 10) enables the conserver 32 to operate in what may be referred to as an "oxygen conserving" mode, and the valve closed position (FIG. 9) enables the conserver to operate in what may be referred to as a "continuous flow" mode. Other orifice and valve systems may be used for controlling the flow through the first control passage 120.

Figure 8:
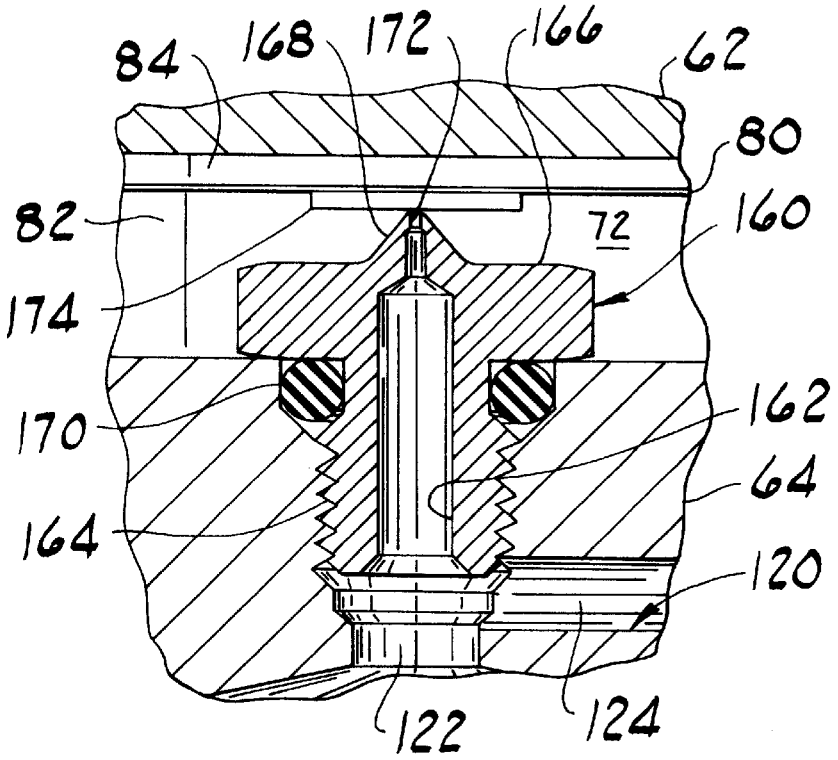
FIG. 8 is a detail of a flow control nozzle of the oxygen conserver/regulator unit.

The vertical passage 122 connecting the second and third chambers 78, 82, respectively, may be referred to as a second flow control passage. This passage 122 is defined in part by a flow control nozzle, generally designated 160, having an axial bore 162 therethrough. As best shown in FIG. 8, the nozzle 160 has a body 164 threadably (and thus removably) secured to the sensing block 64 within the upper end of the flow control passage 122, and a head 166 engageable with the top surface of the sensing block. The top of the head 166 has a conical boss 168 at its center. An O-seal 170 is provided around the body 164 of the nozzle 160 to prevent leakage. The upper portion of the nozzle bore 162 extends up through the conical boss 168 and is formed as an orifice 172 of precise dimension (e.g., 0.0102 in. diameter).

The sensing diaphragm 80 comprises a sheet of flexibly resilient material (e.g., DUREFLEX polyurethane film grade PT6310S provided by Deerfield Urethane, Inc. of South Deerfield, Mass. DUREFLEX is a U.S. federally registered trademark of Deerfield Urethane, Inc.) sandwiched between the sensing and top blocks 64, 62, respectively, of the conserver 32. As will be explained, this diaphragm 80 is movable between a closed position (FIG. 5) in which it engages the boss 168 of the flow control nozzle 160 to prevent the flow of oxygen through the second flow control passage 122, and an open position (not shown) in which the diaphragm is spaced above the nozzle to permit flow through the passage. A seat 174 of sealing material (e.g., DUREFLEX polyurethane film grade PT9200US natural provided by Deerfield Urethane, Inc.) is attached to the underside of the sensing diaphragm 80 for engaging the flow control nozzle 160 when the diaphragm is in its closed position. The seat 174 may be secured to the diaphragm 80 by suitable means, such as radio frequency welding, in which case the seat should be made of the same material as the diaphragm. When in a relaxed condition, the diaphragm 80 is slightly biased toward its closed position.

As shown in FIG. 5, a vent passage 180 is formed in the sensing block 64. This passage 180 extends horizontally from the third chamber 82 to a side of the conserver body 60 to vent the third chamber to atmosphere.

In accordance with one aspect of this invention as shown in FIG. 6, a sensing passage, generally designated 190, in the conserver body 60 connects the outlet passage 94 and the fourth chamber 84 above the sensing diaphragm 80. This passage 190 comprises a horizontal bore 192 in the outlet block 68 extending from the larger hole 114 portion of the outlet passage 94, a vertical bore 194 extending upward through all four blocks 62, 64, 66, 68 and both diaphragms 74, 80 to a location short of the top of the conserver 32, and an angled bore 196 sloping down from the top of the vertical bore to the fourth chamber 84. Of course, this passage 94 may have other configurations without departing from the scope of this invention. Suitable seals are provided in the horizontal bore 192 and between the various blocks around the passage 194 to prevent leakage. (The two diaphragms 74, 80 may provide suitable sealing between respective blocks, as shown. Further, an O-ring 198 may provide sealing between the blocks, as shown.)

Passage 190 is referred to as a "sensing" passage because it is in direct communication with the person using the system 20, via the outlet passage 94 and cannula C attached to the conserver. Thus, inhalation of a person through the cannula C causes a decrease in the pressure in the sensing passage 190, which in turn causes the sensing diaphragm 80 to move to its open position to vent the a second and third chambers 78, 82, respectively, to effect movement of the main diaphragm 74 to its open position for delivery of oxygen to the cannula. Exhalation into the cannula C, on the other hand, causes a pressure increase in the sensing passage 190, which results in movement of the sensing diaphragm 80 to its closed position to allow pressurization of the second chamber 78 via the first control passage 120 (assuming the slide valve 140 is in its open position) to cause the main diaphragm 74 to close and thus interrupt the flow of oxygen to the cannula.

As illustrated in FIG. 6, the horizontal bore 192 of the sensing passage 190 preferably enters the outlet passage 94 of the conserver 32 at a position which is approximately aligned with the lower end of the vertical bore 110 of the nozzle 108. As will be understood by those skilled in the art, the configuration of the nozzle 108 and the relatively narrow diameter of its vertical bore 110 causes a low pressure region to form in the outlet passage 94. This low pressure region increases the sensitivity of the conserver 32 to prevent premature closure of the sensing diaphragm 80 so oxygen is delivered to the patient throughout inhalation. This configuration also allows the conserver 32 to operate at higher flow rates.

It will be observed that the provision of a sensing passage 190 in the body 60 of the conserver 32 eliminates the need for the sensing cannula of a double-tube cannula. Consequently, a single-tube cannula C, which is much preferred by consumers, can be used with the pneumatic conserver 32 of the present invention.

A spring-activated relief valve 200 is provided in a bore 202 extending up from the bottom of the conserver body 60 to the horizontal bore 192 of the sensing passage 190. This valve 200 is designed to open and vent the sensing/outlet passages 190, 94, respectively, in the event of excessive pressure build-up which might otherwise damage the conserver 32. Such a build-up might occur, for example, if the cannula C were to be accidentally pinched to block flow from the conserver 32.

Figure 7:
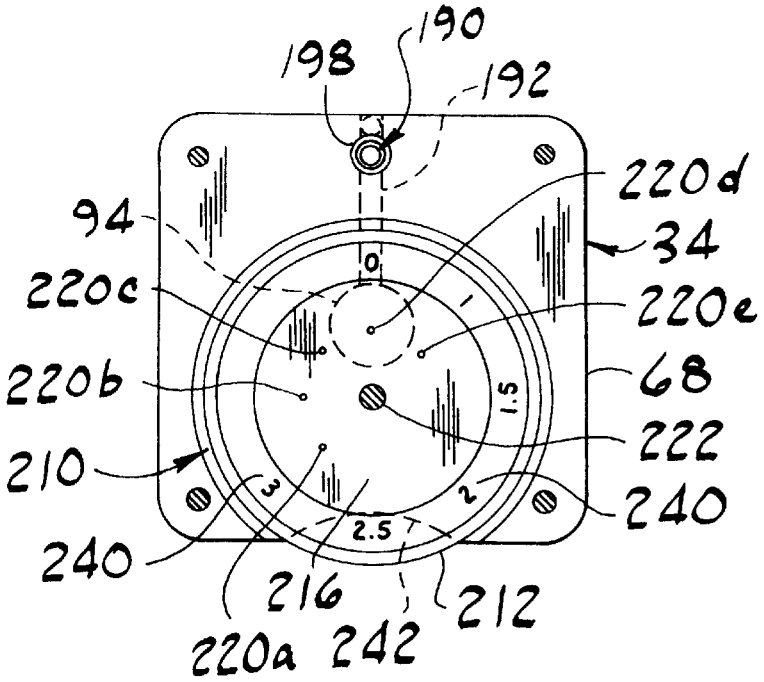
FIG. 7 is a cross section of the oxygen conserver/regulator unit taken in the plane of line 7—7 of FIG. 5 and shown without the regulator.

In accordance with another aspect of this present invention, the conserver 32 of the present invention is provided with a flow control mechanism, generally indicated at 210, for selectively varying the rate of flow through the outlet passage 94. This mechanism 210 comprises a ring 212 received in a horizontal recess 214 formed in the upper part of the outlet block 68, and an orifice plate 216 supported on an annular peripheral shoulder 218 of the ring 212 and secured in place by a pin (not shown) or other suitable means. As illustrated in FIG. 7, the plate 216 has a series of different-size orifices 220*a*–220*e* therethrough spaced at intervals around the plate on an imaginary circle. The ring 212 and plate 216 are rotatable on a vertical shaft 222 which extends through a central opening in the plate into opposing bores 224 in the outlet and inlet blocks 68, 66, respectively, on opposite sides of the plate. The shaft 222 has a vertical axis laterally offset from the centerline of the vertical outlet passage 94 by a distance comparable to the radius of the aforementioned circle on which the various orifices are located, as illustrated in FIGS. 6 and 7. The arrangement is such that the ring 212 and plate 216 are rotatable on the axis of the shaft 222 to any of various positions in each of which a selected orifice 220*a*–220*e* is vertically aligned with the outlet passage 94 for the delivery of oxygen to the cannula C at a selected flow rate corresponding to the size of the orifice. As illustrated in FIG. 5, the ring 212 is releasably held in these positions by a spring-biased detent ball 226 receivable in recesses 228 in the ring (only one of which is visible), there being one recess for each flow rate. For example, the orifices 220*a*–220*e* may be sized to provide flow rates from 1.0 to 3.0 liters per minute (1 pm) in 0.5 lpm increments. Annular seals 230 (e.g., "quad seals") receivable in recesses 232 in the bottom surface of the inlet block 66 and in the top surface of the outlet block 68 wipe against respective top and bottom surfaces of the orifice plate 216 to prevent leakage from the outlet passage 94.

As illustrated in FIG. 7, a portion of the ring 212 projects outwardly from a side of the conserver body 60 so that it may be manually engaged to turn the ring and the orifice plate 216 to a desired position corresponding to the desired flow rate. The outer edge of the ring 212 is preferably knurled to facilitate turning. The ring 212 is provided with suitable markings 240 around its periphery to assist in rotating the ring to a position corresponding to the desired flow rate. The side of the conserver body 60 is preferably recessed to form a vertical concavity 242 to enhance the visibility of these markings and access to the ring 212.

As illustrated in FIG. 1, the housing 34 for the conserver/regulator unit 22 is preferably formed in two parts, an upper part 250 and a lower part 252 each of which is shaped generally to conform to the outline of the conserver and regulator bodies 60, 40, respectively. The upper and lower parts 250, 252, respectively, are releasably fastened together so that they may be separated to provide access to the regulator 30 and conserver 32. In the embodiment shown, the upper and lower parts 250, 252, respectively, are attached to the bodies of the conserver and regulator by screws (not shown). In addition, the upper part 250 is releasably fastened to the lower part 252 by cooperable snap fastening elements (not shown) formed on the parts. Other fastening arrangements can also be used. The housing 34 has a number of openings in it—an opening 260 (FIG. 3) in the side wall of the lower housing part 252 to accommodate the connection of the regulator inlet 42 to the oxygen bottle B; an opening (not shown) in the bottom wall of the lower housing part to accommodate the fitting for connecting the conserver outlet passage 94 to the cannula C; an opening (not shown) in the top wall of the upper housing part 250 for accommodating viewing of the pressure gage 50 and dial; another opening 262 (FIG. 1) in the side wall of the lower part of the housing to accommodate the flow control adjustment ring 212; and an opening 264 (FIG. 1) in the form of a horizontal slot at the juncture of the top and bottom housing parts to accommodate the actuator 152 for switching the conserver between its "oxygen conserving" and "continuous flow"modes. The housing 34 is preferably provided with suitable markings (not shown) at opposite ends of the slot 264 to indicate the position to which the actuator 152 should be moved to operate the conserver 32 in a particular mode. It will be understood that the positions and configurations of the openings in the housing 34 can vary.

The operation of the oxygen conserver/regulator unit 22 during a normal breathing cycle will now be described, first assuming that the conserver 32 is in its "oxygen conserving" mode. Upon inhalation into the cannula C, the pressure in the sensing passage 190 will drop, which will cause the sensing diaphragm 80 to deflect upwardly to its open position away from the conical boss 168 on the flow control nozzle 160. As a result, oxygen in the second chamber 78 will flow through the second flow control passage 122 into the third chamber 82 which is vented to atmosphere via the vent passage 180. The reduction of gas pressure in the second chamber 78 will cause the main diaphragm 74 to move up to its open position away from the outlet nozzle 96 to permit oxygen to flow from the first chamber 76 to the single-tube cannula C via the outlet passage 94. The desired rate of flow selected to the Cannula C is selected by rotating the adjustment ring 212 to position the orifice plate 216 so that the appropriate size orifice 220*a*–220*e* is in line with the outlet passage 94.

Upon exhalation into the cannula C, the pressure in the sensing passage 190 will increase, thereby allowing the diaphragm 80 to move to its closed position blocking flow through the second flow passage 122. This allows the second chamber 78 to repressurize due to the flow of oxygen through the first flow control passage 120, which is open. Repressurization of the second chamber 78 causes the main diaphragm 74 to close, thus interrupting the flow of oxygen to the cannula C. The time required for repressurization will vary according to the size of the flow control orifice 136, the rate of flow, and other factors, but the design should be such that the main diaphragm 74 closes promptly following the start of exhalation to maximize the conservation of oxygen. The cycle then repeats upon inhalation.

To operate the conserver 32 in a "continuous flow" mode, the flow control valve 140 is closed by moving the valve actuator 152 to its appropriate position. When closed, the flow control valve 140 prevents flow through the first flow control passage 120, which prevents repressurization of the second chamber 78 during exhalation. Consequently, the main diaphragm 74 remains in its open position (due to the pressurized oxygen in the first chamber 76) during the entire breathing cycle to provide continuous flow to the cannula C during both exhalation and inhalation. The rate of such continuous flow can be adjusted by using the adjustment ring 212 in the manner described above.

It will be apparent from the foregoing that the conserver 32 of the present invention has many advantages. First, it is pneumatic so that it does not require a power source. Further, the conserver 32 is operable in both "oxygen conserving" and "continuous flow" modes, and the flow rate is adjustable in both modes. Also, in the "oxygen conserving mode", the conserver 32 operates on demand to provide oxygen as it is needed, that is, during the entire inhalation phase, regardless of tidal volume or breathing rate. The provision of a combined regulator 30 and conserver 32 in a single housing 34 also provides for a compact design which, as previously mentioned, increases the convenience of using the system 20 and decreases the obtrusiveness of the design. Moreover, since the main and sensing diaphragms 74, 80, respectively, of the conserver 32 are movable between their open and closed positions without the use of springs, the number of components and complexity of the conserver is reduced.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A pneumatic oxygen conserver adapted for use with a single-tube cannula, said conserver comprising a body having first and second cavities therein, a main diaphragm extending across the first cavity and dividing the cavity into first and second chambers on opposite sides of the diaphragm, an inlet passage in the body for the delivery of oxygen from a supply of oxygen to the first chamber, an outlet passage for the delivery of oxygen from the first chamber to said single-tube cannula, said main diaphragm being movable between a closed position in which flow of oxygen through said outlet passage is prevented and an open position permitting such flow, a first flow control passage in the body connecting said inlet passage and said second chamber, a first flow control orifice in said first flow control passage for restricting flow therethrough, a sensing diaphragm extending across the second cavity and dividing the cavity into third and fourth chambers on opposite sides of the diaphragm, a second flow control passage in the body connecting the second and third chambers, a second flow control orifice in the second flow control passage for restricting flow therethrough, said sensing diaphragm being movable between a closed position in which it prevents flow through said second flow control passage and an open position permitting such flow, a vent passage in the body for venting the third chamber, and a sensing passage in the body connecting the outlet passage and the fourth chamber whereby inhalation by a person into said single-tube cannula causes movement of the sensing diaphragm to its open position to vent the second and third chambers to effect movement of the main diaphragm to its open position for delivery of oxygen to said cannula, and whereby exhalation into said cannula results in movement of the sensing diaphragm to its closed position to allow pressurization of the second chamber to cause the main diaphragm to move to its closed position to interrupt the flow of oxygen to said cannula.

2. A pneumatic oxygen conserver as set forth in claim 1 further comprising a valve in said first flow control passage moveable between an open position in which it permits flow through said first flow control passage for pressurizing said second chamber to enable the conserver to operate in an oxygen conserving mode, and a closed position in which it prevents flow through said first flow control passage to prevent pressurization of said second chamber whereby the main diaphragm remains in its open position for operation of the conserver in a continuous flow mode in which oxygen is continuously delivered to said cannula.

3. A pneumatic oxygen conserver as set forth in claim 2 wherein the valve in said first flow control passage is downstream from said second flow control orifice.

4. A pneumatic oxygen conserver as set forth in claim 3 wherein said main and sensing diaphragms are resiliently flexible and biased toward their closed positions.

5. A pneumatic oxygen conserver as set forth in claim 4 wherein said body comprises a plurality of body parts removably fastened together, and wherein the outlet passage is defined at least in part by an outlet nozzle removably secured to one of the body parts, said main diaphragm being engageable with the outlet nozzle when the diaphragm is in its closed position thereby to block flow through the outlet passage.

6. A pneumatic oxygen conserver as set forth in claim 5 wherein said second flow control passage is defined at least in part by a flow control nozzle removably secured to one of said body parts, and further comprising a seat of sealing material attached to the sensing diaphragm for engagement with said flow control nozzle when the sensing diaphragm is in its closed position thereby to block flow through said second flow control passage.

7. A pneumatic oxygen conserver as set forth in claim 2 further comprising a flow control mechanism for selectively varying the rate of flow through said outlet passage, said flow control mechanism being operable to vary the flow rate in both of said modes.

8. A pneumatic oxygen conserver as set forth in claim 7 wherein said flow control mechanism comprises an orifice plate rotatably mounted on the body and having a series of different-size orifices therethrough spaced at intervals around the plate, said plate being rotatable to a selected position in which a selected orifice is aligned with said outlet passage for the delivery of oxygen to said cannula at a selected flow rate.

9. A pneumatic oxygen conserver as set forth in claim 1 wherein said main and sensing diaphragms are movable between their open and closed positions without the use of springs.

10. A pneumatic oxygen conserver as set forth in claim 1 wherein the outlet passage includes a nozzle for reducing fluid pressure at an exit of the nozzle and said sensing passage is aligned with the nozzle exit.

11. A pneumatic oxygen conserver comprising a body having an inlet passage for receiving oxygen from a source of oxygen and an outlet passage adapted for connection to a cannula for delivery of oxygen to a person, an oxygen conserving mechanism in the body operable in an oxygen conserving mode to permit oxygen to flow from the inlet passage to the outlet passage of the body during inhalation by the person and to block the flow of oxygen to said outlet passage during exhalation by the person, and in a continuous flow mode to permit the continuous flow of oxygen to said person during both inhalation and exhalation, and a flow control mechanism on the conserver body operable when said conserving mechanism is in either of said modes to vary the rate of oxygen flow through said outlet passage.

12. A pneumatic oxygen conserver as set forth in claim 11 wherein said flow control mechanism comprises an orifice plate rotatably mounted on the body and having a series of different-size orifices therethrough spaced at intervals around the plate, said plate being rotatable to a selected position in which a selected orifice is aligned with said outlet passage for the delivery of oxygen to said cannula at a selected flow rate.

13. A pneumatic oxygen conserver as set forth in claim 11 wherein body has first and second cavities therein, and wherein said oxygen conserving mechanism comprises a main diaphragm extending across the first cavity and dividing the cavity into first and second chambers on opposite sides of the diaphragm, said inlet and outlet passages communicating with said first chamber, said main diaphragm being movable between a closed position in which the flow of oxygen through said outlet passage is prevented, and an open position permitting such flow, a first flow control passage in the body connecting said inlet passage and said second chamber, a first flow control orifice in said first flow control passage for restricting flow therethrough, a sensing diaphragm extending across the second cavity and dividing the cavity into third and fourth chambers on opposite sides of the diaphragm, a second flow control passage in the body connecting the second and third chambers, a second flow control orifice in the second flow control passage for restricting flow therethrough, said sensing diaphragm being movable between a closed position in which it prevents flow through said second flow control passage, and an open position permitting such flow, a vent passage in the body for venting the third chamber, and a sensing passage providing communication between a person using the conserver and said fourth chamber whereby inhalation by the person into said cannula causes movement of the sensing diaphragm to its open position to vent the second and third chambers to effect movement of the main diaphragm to its open position for delivery of oxygen to said cannula, and whereby exhalation by said person results in movement of the sensing diaphragm to its closed position to allow pressurization of the second chamber to cause the main diaphragm to move to its closed position to interrupt the flow of oxygen to said cannula.

14. A pneumatic oxygen conserver as set forth in claim 13 further comprising a valve in said first flow control passage moveable between an open position in which it permits flow through said first flow control passage for pressurization of said second chamber to enable the conserver to operate in said oxygen conserving mode, and a closed position in which it prevents flow through said first flow control passage to prevent pressurization of said second chamber whereby the main diaphragm remains in its open position for operation of the conserver in said continuous flow mode.

15. A springless pneumatic oxygen conserver comprising a body having first and second cavities therein, a main diaphragm extending across the first cavity and dividing the cavity into first and second chambers on opposite sides of the diaphragm, an inlet passage in the body for the delivery of oxygen from a supply of oxygen to the first chamber, an outlet passage for the delivery of oxygen from the first chamber to a cannula connected to the body, said main diaphragm being movable between a closed position in which the flow of oxygen through said outlet passage is prevented, and an open position permitting such flow, a first flow control passage in the body connecting said inlet passage and said second chamber, a first flow control orifice in said first flow control passage for restricting flow therethrough, a sensing diaphragm extending across the second cavity and dividing the cavity into third and fourth chambers on opposite sides of the diaphragm, a second flow control passage in the body connecting the second and third chambers, a second flow control orifice in the second flow control passage for restricting flow therethrough, said sensing diaphragm being movable between a closed position in which it prevents flow through said second flow control passage, and an open position permitting such flow, a vent passage in the body for venting the third chamber, and a sensing passage providing communication between said cannula and said fourth chamber whereby inhalation by a person into the cannula causes movement of the sensing diaphragm to its open position to vent the second and third chambers to effect movement of the main diaphragm to its open position for delivery of oxygen to said cannula, and whereby exhalation into the cannula results in movement of the sensing diaphragm to its closed position to allow pressurization of the second chamber to cause the main diaphragm to move to its closed position to interrupt the flow of oxygen to said cannula, said main and sensing diaphragms being movable between their open and closed positions without the use of springs.

16. A springless pneumatic oxygen conserver as set forth in claim 15 wherein said main and sensing diaphragms are resiliently flexible and biased toward their closed positions.

17. An oxygen conserver/regulator unit comprising a housing, a regulator in the housing, said regulator comprising a regulator body having an inlet adapted for connection to a source of high-pressure oxygen and an outlet, and a pressure regulating mechanism in the regulator body operable to receive oxygen from said inlet at a first pressure and to reduce the pressure of the oxygen to a second lower pressure for delivery of lower-pressure oxygen to said outlet, a pneumatic oxygen conserver in the housing immediately adjacent the regulator, said conserver comprising a conserver body having an inlet passage adjacent the outlet of the regulator body for receiving said lower-pressure oxygen and an outlet passage adapted for connection to a cannula for delivery of the lower-pressure oxygen thereto, and a mechanism in the conserver body operable in an oxygen conserving mode to permit oxygen to flow from the inlet passage to the outlet passage of the conserver body during inhalation by the person and to interrupt the flow of oxygen to said outlet passage during exhalation by the person, an opening in the housing for accommodating the connection of the regulator inlet to said source of oxygen, and an opening in the housing for accommodating the connection of the conserver outlet passage to said cannula.

18. An oxygen conserver/regulator unit as set forth in claim 17 further comprising a flow control mechanism on the conserver body for varying the rate of oxygen flow to said outlet passage during said inhalation, said flow control mechanism comprising a manually movable actuator, and an opening in the housing for receiving said actuator therein so that it is accessible to a person using the unit.

19. An oxygen conserver/regulator unit as set forth in claim 18 wherein said housing comprises two housing parts releasably fastened together so that the housing parts may be separated to provide access to the regulator and conserver therein.

20. An oxygen conserver/regulator unit as set forth in claim 19 wherein said regulator includes a pressure gauge, and wherein said housing has an opening therein for said pressure gauge.

21. An oxygen conserver/regulator unit as set forth in claim 18 wherein said conserver is operable in a second mode wherein oxygen is delivered continuously from the inlet passage of the conserver to the outlet passage of the conserver during both inhalation and exhalation by said person, said conserver comprising an actuator for switching between said two modes, and an opening in the housing for accommodating the actuator so that it is accessible to a person using the unit.

22. An oxygen conserver/regulator unit as set forth in claim 17 wherein the body of the regulator is disposed in face to face contact with the body of the conserver in the housing for maximum compactness.

* * * * *